United States Patent [19]

Chase

[11] 4,441,550

[45] Apr. 10, 1984

[54] CROSS-OVER BUNDLE FOR HEAT EXCHANGER

[75] Inventor: A. Timothy Chase, Warren, Pa.

[73] Assignee: Struthers Wells Corporation, Warren, Pa.

[21] Appl. No.: 457,978

[22] Filed: Jan. 14, 1983

[51] Int. Cl.[3] ..... F28D 7/06; F28F 9/22

[52] U.S. Cl. ..... 165/145; 165/163; 165/176

[58] Field of Search ..... 165/163, 172, 176, 150, 165/145, 174, 158

[56] References Cited

U.S. PATENT DOCUMENTS

| | | | |
|---|---|---|---|
| 11,661 | 9/1854 | Carpenter | 165/176 |
| 1,024,798 | 4/1912 | Marot | 165/172 X |
| 1,170,071 | 2/1916 | Keagy | 165/172 |
| 1,309,025 | 7/1919 | Geoghegan | 165/176 |
| 1,421,247 | 6/1922 | Keenan, Jr. | 165/176 |
| 1,931,467 | 10/1933 | Young | 165/172 X |
| 2,267,314 | 12/1941 | Stikeleather | 165/172 X |
| 2,537,678 | 1/1951 | Koetting | 165/172 X |
| 3,250,323 | 5/1966 | Karmazin | 165/172 X |
| 4,121,656 | 10/1978 | Huber | 165/174 X |

*Primary Examiner*—Sheldon Richter

*Attorney, Agent, or Firm*—Buell, Blenko, Ziesenheim & Beck

[57] ABSTRACT

Apparatus for connecting tube banks in a shell and tube heat exchanger comprises a tube sheet co-extensive with the ends of a pair of adjoining tube banks into which tube sheet a plurality of aligned U-bends are fitted at their ends. The U-bends are positioned to connect each tube end in one bank with its mirror image tube end in the adjoining bank.

4 Claims, 4 Drawing Figures

CROSS-OVER BUNDLE FOR HEAT EXCHANGER

This invention relates to a multiple pass shell and tube heat exchangers. It is more particularly concerned with apparatus for connecting the ends of the tubes in adjoining passes.

BACKGROUND OF THE INVENTION

Shell and tube heat exchangers are conventionally constructed with the heat exchanger tubes arranged in parallel banks or passes within the heat exchanger shell. The tubes may be straight, in which case each bank of tubes must be connected at each end with an adjoining bank, which may be beside it, above it, or below it. The heat exchanger tubes are usually of small diameter, on the order of ¾–1 inch, and are arranged with close center-to-center spacing, generally on the order of 1¼ tube diameters. A bank may comprise hundreds of these tubes. It is not feasible to connect individual tubes in such assemblies by conventional means. Conventionally, the tubes have been fitted into a tube sheet at each end, which tube sheet forms a wall of a plenum chamber. Plenum chambers of adjoining passes have been connected by ducts.

While the conventional construction above outlined is satisfactory for many purposes, it is undesirable where the medium passing through the tubes is two-phase, such as a gas and liquid, or a slurry of solids in liquid. In the plenum chamber the constituents of such medium can separate, rendering the flow through suceeding tube banks non-homogeneous. The opportunity for phase separation may be halved by utilizing U-tubes in the heat exchanger, the tubes being arranged so that their bends connect the tube banks in adjoining passes in the same plane. It is not feasible, however, to construct heat exchangers having tubes with successive U-bends in planes normal to each other.

SUMMARY OF THE INVENTION

My apparatus for connecting tube banks comprises a tube sheet co-extensive with the ends of a pair of adjoining tube banks into which a plurality of U-bends are fitted at their ends, the U-bends being positioned to connect each tube end in one bank or pass with its mirror image tube end in the adjoining pass. The tubes in a bank are regularly arranged in ranks and files. The U-bends in my apparatus are also regularly arranged so that their ends in the tube sheet are in corresponding ranks and files. The U-bends in each file, for example, are nested in the same plane, which is the plane of the file, and the planes of successive files of U-bends are parallel.

DESCRIPTION OF PREFERRED EMBODIMENT

Figure 1:
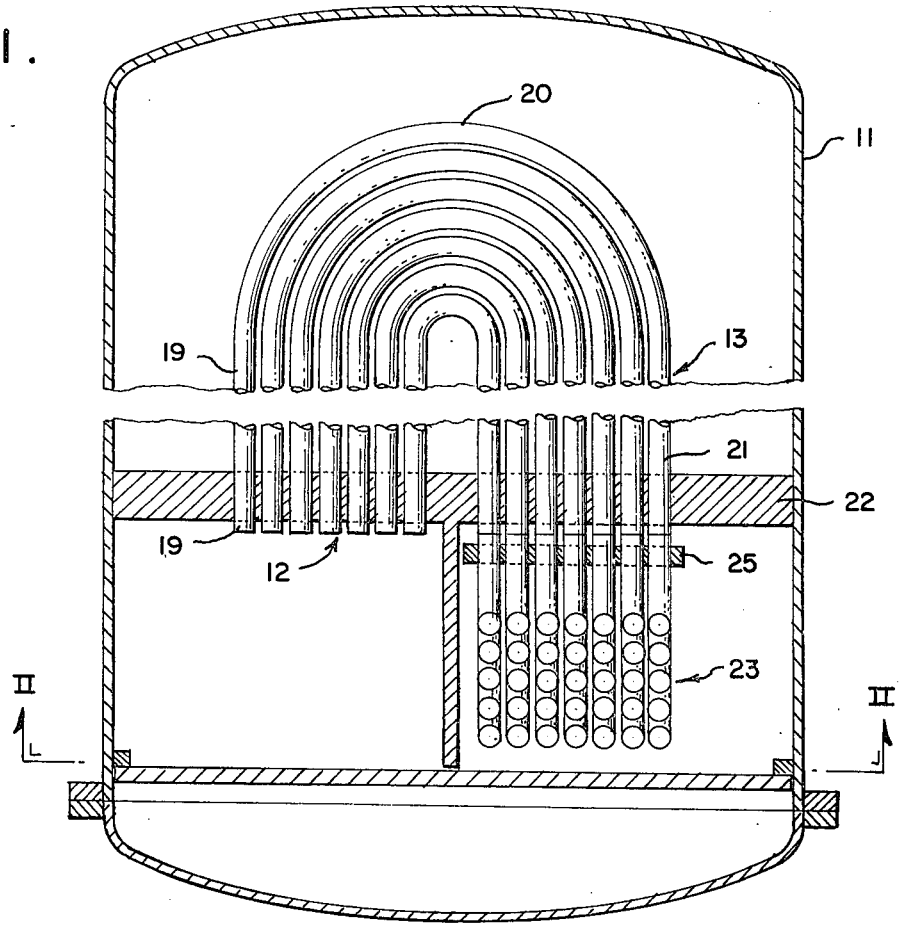
FIG. 1 is a horizontal section of a heat exchanger including my apparatus taken on the plane I—I of FIG. 2.
Figure 2:
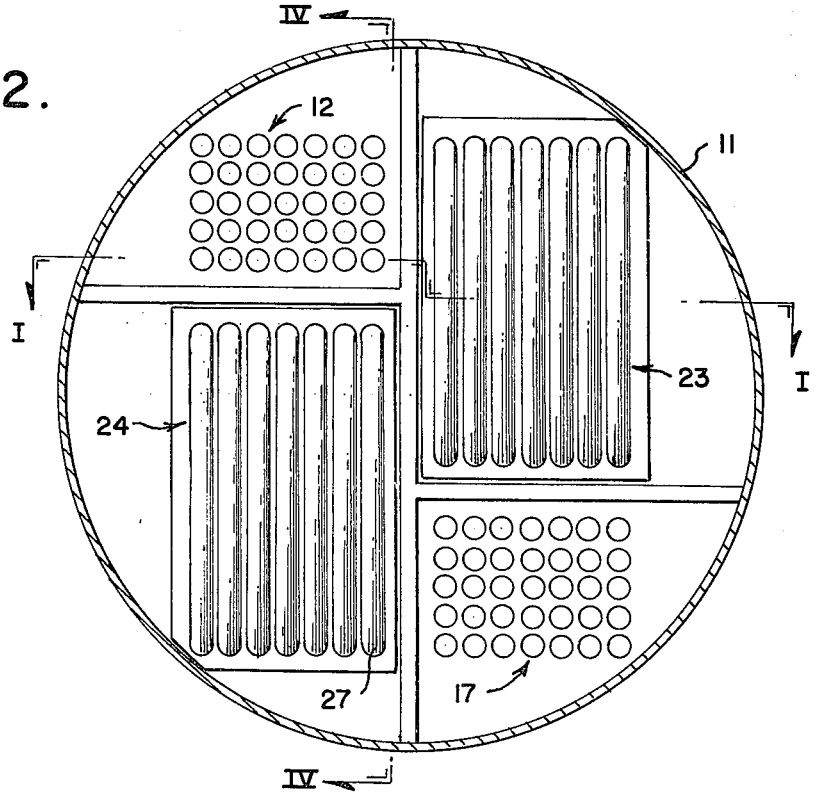
FIG. 2 is a vertical cross section of the apparatus of FIG. 1 taken on the plane II—II of FIG. 1.
Figure 3:
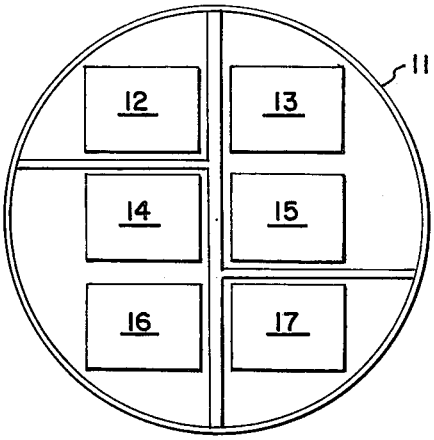
FIG. 3 is a schematic vertical cross section through a heat exchanger showing one arrangement of passes.

Heat exchangers suitable for my invention comprise a shell 11 within which is positioned a number of passes or banks of tubes. In FIG. 3 the shell 11 contains six banks, 12 through 17 inclusive, arranged two across and three high, as is there shown. Each bank or pass comprises a plurality of tubes in parallel arranged longitudinally therein in horizontal and vertical alignment. The horizontal layers of tubes are hereinafter called ranks and the vertical layers of tubes are hereinafter called files. In FIG. 2 are shown end views of the tubes in passes 12 and 17, arranged in ranks of 7 and files of 5 tubes, as above defined. The tubes in all other passes are arranged in the same ranks of 7 and files of 5. FIG. 1 shows that the tubes in each rank of pass 12 are connected with the tubes in the corresponding rank of pass 13, being bent into nesting U's at one pair of adjoining ends. Tube 19, for example, in the last rank and first file of pass 12 is bent into a semicircle 20 and continues as tube 21 in the last rank and last file of pass 13. The remaining tubes in the last rank of pass 12 are connected with the remaining tubes in the last rank of pass 13 in the same way, each tube end in pass 12 being connected with its mirror image tube end in pass 13 by a semi-circular bend, those bends being nested within each other in the plane of the last tube rank. Bend 20 and like bends in the same pass and passes below it are positioned at the same end of shell 11.

Figure 4:
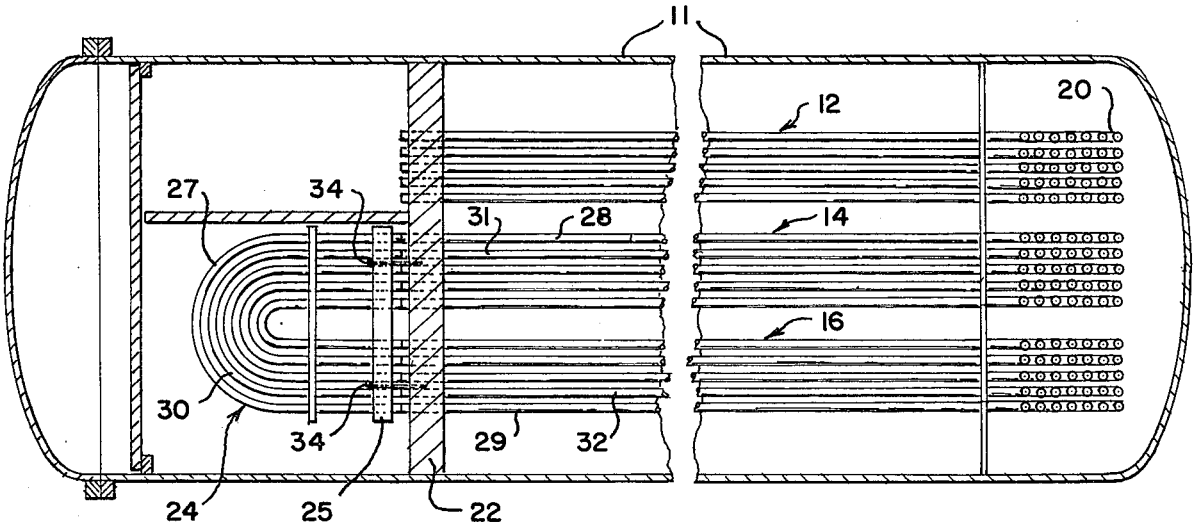
FIG. 4 is a vertical section through the apparatus of FIG. 1 taken on the plane IV—IV of FIG. 2.

At the other end of shell 11 the ends of all tubes in all passes are fixed in a vertical tube sheet 22. Connections between the tubes in pass 13 with those in pass 15 and between the tubes in pass 14 with the tubes in pass 16 are made by cross-over bundles of my invention, shown in FIGS. 1, 2 and 4. Cross-over bundle 23 shown in FIG. 1 connects banks 13 and 15 while cross-over bundle 24 shown in FIGS. 2 and 4 connects banks 14 and 16. The bundles are identical in construction. Each comprises a tube sheet 25 co-extensive in area with the ends of the two adjoining tube banks it connects. Into this tube sheet are fitted 180° U-bends, each U-bend being arranged and positioned to connect one end of a tube in one of the connected passes with the mirror image end of a tube in the other connected pass. U-bend 27, for example, shown in FIGS. 2 and 4, connects tube 28 in the first rank and last file of bank 14 with tube 29 in the last rank and last file of bank 16. The ends of those tubes in tube sheet 22 are mirror images of each other about a horizontal axis between banks 14 and 16. U-bend 30 nested immediately inside U-bend 27 in the same file connects the end of tube 31 immediately below tube 28 in bank 14 with the end of tube 32 immediately above tube 29 in bank 16. Those ends, again, are mirror images of each other. U-bends 27 and 30 and the remaining U-bends in the same file of my cross-over bundle 24 have bend radii terminating on the same horizontal axis.

The adjoining ends of tubes in my cross-over bundle and associated passes abut each other when my cross-over bundle tube sheet 25 is positioned against my main bundle tube sheet 22. The respective tube sheets are held against each other by fasteners 34. The adjoining tube ends may be dimensioned so that one slips over the other, if desired.

It will be evident that the use of my cross-over bundles as described hereinabove makes feasible the construction of multiple pass shell and tube heat exchangers in which the medium passing through the heat exchanger tubes may be multi phase, but will not segregate in the connections between passes.

I claim:

1. A cross-over bundle for connecting in series the corresponding tubes in adjoining tube side passes in multiple pass shell and tube heat exchangers in which each pass includes a bank of tubes having center-to-center spacing between tubes only slightly greater than the tube diameter, the tubes in each bank terminating in a first tube sheet, comprising a second tube sheet co-extensive with the ends of adjoining tube banks, a plurality of tube U-bends having their ends fixed in said second tube sheet, and fastening means for holding said first and second tube sheets against each other so that the U-bends are positioned to connect each tube end in one bank with its mirror image tube end in the adjoining bank.

2. The cross-over bundle of claim 1 in which the tubes in each bank are arranged in ranks and files and the ends of the tube U-bends are arranged in mirror image ranks and files.

3. The cross-over bundle of claim 2 in which the tube U-bends are arranged in parallel planes.

4. The cross-over bundle of claim 3 in which the axes of the tube U-bends in each plane are concentric.

* * * * *